US005680996A

United States Patent [19]

Sadler, III

[11] Patent Number: 5,680,996

[45] Date of Patent: Oct. 28, 1997

[54] GAS FLUIDIZED-BED STIRRED MEDIA MILL

[75] Inventor: Leon Y. Sadler, III, Tuscaloosa, Ala.

[73] Assignee: The United States of America is represented by the Dept. of Energy, Washington, D.C.

[21] Appl. No.: 528,275

[22] Filed: Sep. 14, 1995

[51] Int. Cl.[6] ..... B02C 17/16

[52] U.S. Cl. ..... 241/57; 241/171; 241/172

[58] Field of Search ..... 241/171, 172, 241/57

[56] References Cited

U.S. PATENT DOCUMENTS

| | | | |
|---|---|---|---|
| 3,913,847 | 10/1975 | Glatt et al. | 241/57 X |
| 4,256,264 | 3/1981 | Hansen et al. . | |
| 4,370,198 | 1/1983 | Dencs et al. | 241/57 X |
| 4,556,175 | 12/1985 | Motoyama et al. | 241/57 |
| 4,676,439 | 6/1987 | Saito et al. . | |
| 4,811,909 | 3/1989 | Inoki | 241/57 X |
| 5,024,387 | 6/1991 | Yeh . | |
| 5,080,293 | 1/1992 | Szegvari et al. . | |
| 5,184,782 | 2/1993 | Kerstges et al. . | |
| 5,199,656 | 4/1993 | Szegvari et al. . | |
| 5,330,112 | 7/1994 | Nagaoka et al. | 241/57 |

*Primary Examiner*—Mark Rosenbaum

*Attorney, Agent, or Firm*—Thomas G. Anderson; Robert J. Fisher; William R. Moser

[57] ABSTRACT

A gas fluidized-bed stirred media mill is provided for comminuting solid particles. The mill includes a housing enclosing a porous fluidizing gas diffuser plate, a baffled rotor and stator, a hollow drive shaft with lateral vents, and baffled gas exhaust exit ports. In operation, fluidizing gas is forced through the mill, fluidizing the raw material and milling media. The rotating rotor, stator and milling media comminute the raw material to be ground. Small entrained particles may be carried from the mill by the gas through the exit ports when the particles reach a very fine size.

20 Claims, 2 Drawing Sheets

GAS FLUIDIZED-BED STIRRED MEDIA MILL

BACKGROUND OF THE INVENTION

1. Field of the Invention

The present invention relates generally to an apparatus and method for reducing the size of solid particles. More particularly, the present invention relates to an apparatus and method for grinding solid particles using a gas fluidized-bed stirred media mill.

2. Description of the Prior Art

Stirred media mills are widely used to comminute, i.e. reduce the size of, coarse particles, during production of ceramics and metallic materials, pigments, coatings and pharmaceutical powders. These conventional mills include the Drais Stirred Ball Mill manufactured by the Draiswerke GMBH, the U.S. Bureau of Mines-developed Attrition, or Turbo-mill, and the TecaMill manufactured by Tecaro AG of Switzerland.

During operation of these conventional mills, a slurry composed of milling media, material being ground, and a liquid suspending medium is placed in a tank. The slurry is then vigorously stirred by an impeller. A stator, also fitted with baffles, is usually positioned within the tank and cooperates with the impeller to comminute individual particles suspended in the slurry.

It has been found that to maintain a given impeller speed in such a mill, power input must be increased as the liquid-phase density increases. This becomes more pronounced at higher impeller speeds, approximately doubling for each doubling of the liquid phase density. Additionally, fluids with higher viscosity increase the energy consumed by the mill. As a result, less than 1 percent of the mechanical energy supplied to conventional mills is available for producing new surfaces. The remaining energy is dissipated through friction between the slurry's constituent elements, the tank's walls, any cooling elements, the impeller, and the stator. Conventional mills, therefore, must be jacketed or fitted with cooling coils to remove heat, adding to the cost and complexity of these mills.

In summary, conventional stirred media mills generally employ liquid suspending mediums and much of the energy supplied to the mill is dissipated as heat into the liquid. The energy lost through friction between the stirred media mill's constituent elements is not available for comminution resulting in a decrease in the stirred media mill's efficiency.

SUMMARY OF THE INVENTION

It is therefore an object of the present invention to provide a stirred media mill which will provide increased energy efficiency.

It is a further object to provide a stirred media mill employing a gas fluidized-bed medium for suspending particles during comminution.

These objects are accomplished by incorporating the following principles. As noted above, energy dissipation may be directly related to the suspending medium's viscosity and density. Gases, in contrast to liquids, generally have lower viscosities and densities. To illustrate, conventional mills often use water as the suspending medium. At room temperature, water has a viscosity of $1\times10^{-3}$ PaS and a density of 1000 kg/m$^3$. In comparison, air at 1 atmosphere of pressure and room temperature has a viscosity of about $1.8\times10^{-5}$ PaS and a density of 1.2 kg/m$^3$. Accordingly, if a gas were used as a suspending medium in a stirred media mill, the amount of energy used to overcome the suspending medium's viscosity and density effects would be reduced. More energy would then be available to comminute the suspended particles.

A gas may be used to suspend solid particles through gas fluidization and fluidized-bed techniques. The terms "gas fluidization" and "fluidized-bed" describe the conditions in which individual particles become suspended in a gas flowing at or above a critical fluidization velocity. The minimum fluidization velocity with which the gas must flow is the velocity at which the pressure drop across the bed of particles is equal to the weight of the particles.

At velocities above this minimum fluidization velocity, the particles begin to move about in the bed and become suspended in the flowing gas. At sufficiently high velocities, individual particles may become entrained in the flowing gas and may be transported away from the fluidized-bed. Particle entrainment occurs when the fluidizing gas velocity is greater than the particles's terminal settling velocity. As a general rule, coarse particles settle faster than smaller particles. Consequently, the fluidizing gas velocity may be controlled to selectively entrain, or purposely not entrain, particles with a known settling velocity.

In practice, a dynamic impeller and baffle system in a stirred media mill results in rapid changes in direction of the fluid and suspended particles. Milling media particles are forced to collide with each other, the rotor and the stator. The material to be comminuted is trapped between rapidly moving media particles and between media particles and the rotor's and stator's solid surfaces. The resulting collisions and shearing forces effectively comminute the particles.

A stirred media mill incorporating a gas fluidized-bed would have several advantages over a stirred media mill incorporating a liquid suspending medium. For example, more energy input is required to force changes in directions of high-density suspending fluids (liquids) than of low-density suspending fluids (gasses). Energy required to overcome the suspending fluid's viscous resistance to the impeller would be drastically reduced in a gas fluidized environment. Additionally, in a gas fluidized-bed, media particles would be able to maintain high velocities between collisions and could undergo multiple collisions without suffering loss of energy due to viscous dissipation in the suspending liquid. This energy, then, would be available for comminution and would result in the stirred media mill having a higher energy efficiency.

Also, in a gas fluidized-bed mill, gas is continuously introduced and removed from the mill. If this gas travels with sufficient velocity to entrain individual finely ground particles, these particles would be continuously removed from the milling zone. This continuous removal of ground particles would prevent energy from being wasted on further comminution and would prevent particle degradation due to over grinding.

Additionally, product surface contamination resulting from contact with the suspending liquid and the cost of drying powder products would also be eliminated by using a gas fluidized-bed mill. Finally, agglomeration of product powder during drying of the product from a liquid suspension mill and the problems of returning it to the individual particle state would be eliminated if the fluidized-bed mill is used.

In a preferred embodiment, a gas fluidized-bed stirred media mill includes: a hollow cylindrical housing having an upper end and a lower end; a lower plug enclosing the lower end of the housing, the plug including a gas inlet hole and communicating with a pressurized fluidizing gas supply; a means for diffusing the fluidizing gas throughout the lower end of the housing and supporting a volume of particles to be comminuted into relatively large and relatively small particles; a means for agitating and comminuting the volume of particles; an upper plug enclosing the upper end of the housing; a means for exiting the fluidizing gas from the housing; a means for preventing the relatively large media and course material being ground particles from exiting the housing and returning the particles to the agitated volume; and a means for allowing the relatively small particles to exit the housing.

Other objects and features of the present invention will be apparent from the following detailed description of the preferred embodiment.

BRIEF DESCRIPTION OF THE DRAWINGS

The invention will be further described in conjunction with the accompanying drawings, in which.

DETAILED DESCRIPTION OF THE PREFERRED EMBODIMENT

Figure 1:
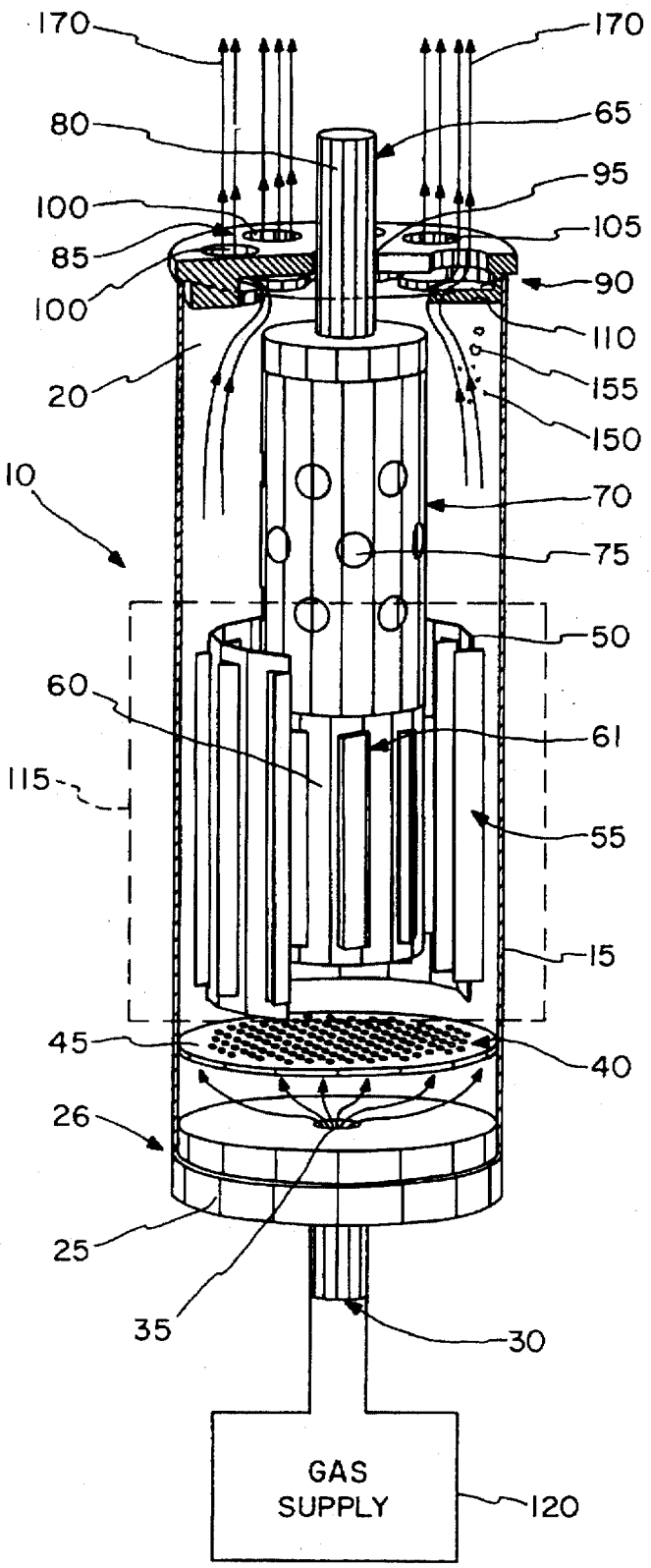
FIG. 1 is a cross-sectional view of a gas fluidized-bed stirred media mill constructed in accordance with a preferred embodiment of the invention.

With reference to FIG. 1, a gas fluidized-bed stirred media mill 10 incorporating these principles includes a housing 15 with an inner surface 20 and a lower plug 25. Lower plug 25 encloses a bottom 26 of housing 15 and includes a downwardly depending tube 30 having a centrally located gas inlet hole 35. Gas inlet hole 35 allows introduction of fluidizing gas 170 into media mill 10 from a conventional gas supply 120.

Located within housing 15 and immediately above lower plug 25 is a fluidizing gas diffuser plate 40 having an upper surface 45. Fluidizing gas 170 is forced through fluidizing gas diffuser plate 40 and, upon exiting fluidizing gas diffuser plate 40, is evenly distributed across upper surface 45.

By way of example but not limitation, housing 15 may be constructed of conventional 5.0 in. I.D.×5.5 in. O.D. plastic tubing. Lower plug 25 may be constructed of plastic, ceramic or metal. Fluidizing gas diffuser plate 40 may be constructed of a sintered stainless steel powder disc 0.125 in. thick having 35 micrometers diameter pores although any other powdered metal, porous ceramic or plastic may be utilized. Fluidizing gas may be air, inert gasses, reactive gasses, or any other gas.

A squirrel-cage stator 50 having a plurality of baffles 55 is enclosed within housing 15 and is rigidly attached to inner surface 20 of housing 15 at a position above fluidizing gas diffuser plate 40. A turbine-type squirrel-cage impeller 60 rotates inside stator 50 and also has a plurality of baffles 61. Impeller 60 includes an elongated drive shaft 65 having a hollow portion 70 with a number of lateral vents 75 and a solid portion 80. Solid portion 80 is smaller in diameter than hollow portion 70 and extends upwardly beyond a top 90 of housing 15. During operation, impeller 60 rotates within stator 50 comminuting the particles between baffles 55 and 61.

A grinding zone 115 inside media mill 10 is defined by upper surface 45 of fluidizing gas diffuser plate 40, inner surface 20 of housing 15 and a top of stator 50. This grinding zone is partially filled with a volume of particles to be comminuted (not shown). Fluidizing gas is then forced through fluidizing gas diffuser plate 40 at or above a critical velocity. This critical velocity is dependent on the size and diameter of the milling media particles and of the course materials being comminuted. The fluidizing gas passes through the grinding zone 115 and fluidizes the bed of milling media particles and particles to be comminuted (not shown).

Figure 2:
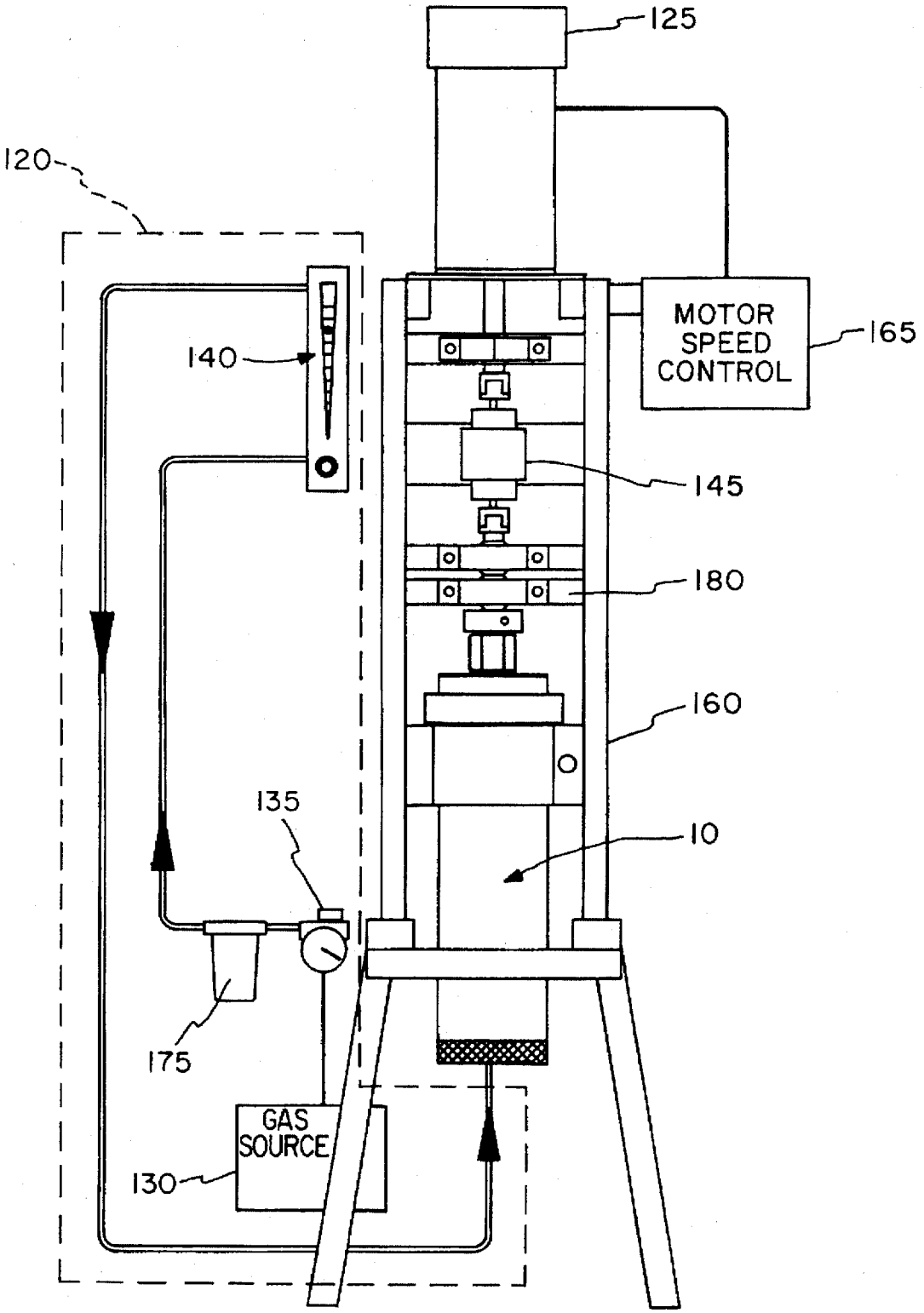
FIG. 2 is a side view of a gas fluidized-bed stirred media milling system.

In the preferred embodiment, stator 50 and impeller 60 are constructed of relatively thin, i.e. 1/16 in thick, metal in order to maximize the fraction of the mill cross-section that remains open to the upward passage of fluidizing gas and to minimize interference with the fluidization process. Impeller 60 is driven by a conventional variable-speed electric motor 125 (FIG. 2).

Referring again to FIG. 1, an upper plug 85 encloses top 90 of housing 15. Upper plug 85 includes a centrally located hole 95 of sufficient diameter to allow passage of solid portion 80 of drive shaft 65. Upper plug 85 also includes a plurality of exhaust ports 100 allowing fluidizing gas 170 to exit. Exhaust ports 100 include a number of openings 105 passing through upper plug 85 and which are shielded by deflectors 110. Deflectors 110 deflect any coarse particles 155 having a sufficient velocity and trajectory to otherwise pass through an opening 105.

In the preferred embodiment, deflectors 110 are integrally formed plates rigidly suspended immediately beneath each opening 105 but may also be any series of chambers or obstacles sufficiently positioned to prevent coarse particles 155 from exiting grinding zone 115. In the alternative, exhaust ports 100 may be positioned to minimize exposure to coarse particles 155 with the requisite trajectories and velocities.

During comminution, small sized particles 150 may become entrained in fluidizing gas exiting grinding zone 115. Although baffled gas exhaust ports 100 prevent coarse particles 155 from escaping media mill 10, entrained small sized particles 150 may be removed from media mill 10 with exiting fluidized gas 170 passing through baffled gas exhaust ports 100. In the preferred embodiment, entrained small sized particles 150 exit grinding zone 115 by travelling around deflectors 110 and passing through openings 105.

As illustrated in FIG. 2, the preferred embodiment further includes a vertical support stand 160 vertically supporting media mill 10 and an electric motor 125. Electric motor 125 is controlled by a conventional motor speed control 165 and is coupled with bearings 180 and a conventional torque/rotational speed sensor 145 to monitor the torque and rotational speed of impeller 60 (FIG. 1). External to support stand 160 and communicating with media mill 10 is gas supply 120. Gas supply 120 includes a conventional gas source 130 supplying fluidizing gas 170 to a gas filter 175 for removing oil, water or any other impurities from fluidizing gas 170. Gas source 130 may also be monitored by a gas flowmeter 140 and moderated by a gas pressure regulator 135.

In the preferred embodiment, vertical stand 160 may be constructed of metal, plastic or wood. Electric motor 125 may be any variable speed motor such as model 42226, manufactured by Dayton Electric Manufacturing Company. Bearings 180 are conventional bearings such as model TL216 manufactured by Browning Corporation. Motor speed control 165 may be any conventional motor speed controller, such as an 11-amp capacity motor speed controller manufactured by Dayton Electric Manufacturing Company. Torque/rotational speed sensor 145 may be any conventional torque/rotational speed sensor, such as model 1602-1K, manufactured by Lebow (Eaton Corporation). Gas source 130 may be any conventional gas source including a typical production plant compressed air supply, compressed gas tank or air pump.

Gas filter 175 may be model 47034, manufactured by Speedair. Gas flowmeter 140 may be any conventional gas flowmeter, such as a 0-14SCFH rotameter with a flow control valve, manufactured by King Instrument Company. Finally, gas pressure regulator 135 may be any conventional gas flow rate control valve, such as model 178-838D, manufactured by Speedair.

A gas fluidized-bed stirred media mill constructed in accordance with the preferred embodiment was tested and yielded the following results. Stirred-media mill performance was studied using 30/40 mesh (U.S.) solid glass spheres as the milling media and 48/100 mesh (U.S.) dolomite grain as the material to be comminuted. Air, when used as the fluidizing gas, was introduced into the mill with a velocity of 0.80 ft/s.

The test program was designed to permit a comparison of energy efficiency between three different suspending media. The three tested suspending media were:

(1) No suspending medium.

(2) Conventional liquid (water).

(3) Air.

Prior to testing, the specific surface area of the dolomite grain was measured. The stirred-media mill was then charged with approximately 1500 grams of milling media and 370 grams of dolomite grain. Additionally, 810 milliliters of water were added in Test Number 1. In Test Number 3, the air flow rate was adjusted to provide a superficial air velocity of 0.80 ft/s.

The mill was then operated at approximately 2000 rev./s and the torque delivered to the impeller and the impeller's rotational speed were recorded. The measured torque value was corrected to remove the effects of bearing friction. The torque and rotational speed values were converted to power input to the impeller and were plotted against milling time. The product of power input to the impeller and milling time yielded the mill's energy input.

The mill was operated for two hours, after which the contents were separated into coarse milling media and dolomite grain fractions. The specific surface area of the dolomite grain product was measured and incorporated with the dolomite grain product's weight to determine the total surface area of the dolomite grain product.

Finally, the stirred-media mill energy efficiency was calculated as the ratio of the surface area generated during comminution to the energy supplied to the impeller during comminution.

Test results from each of these test modes are summarized below in Table 1.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A gas fluidized-bed stirred media mill, comprising:

a hollow cylindrical housing having an upper end and a lower end;

a lower plug enclosing said lower end of said housing, said plug including a gas inlet hole and communicating with a fluidizing gas supply;

a means for evenly diffusing said fluidizing gas throughout said lower end of said housing and supporting a volume of particles to be comminuted into relatively large and relatively small particles;

a means for suspending a substantial portion of said volume of particles to be comminuted;

a means for agitating and comminuting said volume of particles;

an upper plug enclosing said upper end of said housing; and a means for exiting said fluidizing gas from said housing.

2. A gas fluidized-bed stirred media mill as claimed in claim 1, wherein said means for diffusing said fluidizing gas comprises a fluidizing gas diffuser plate constructed of a rigid, porous plate.

3. A gas fluidized-bed stirred media mill as claimed in claim 1, wherein said means for agitating and comminuting said volume of particles comprises:

a stator including a plurality of baffles, said stator disposed within said housing and rigidly affixed to an inner surface of said housing and located above said fluidizing gas diffuser plate; and a rotor rotatably disposed within said housing, containing a plurality of baffles, said rotor including a lower portion including a plurality of lateral vents, and an upper portion extending through said upper plug and operatively coupled to a means for rotating said rotor.

4. A gas fluidized-bed stirred media mill as claimed in claim 1, wherein said means for exiting said fluidizing gas from said housing comprises a plurality of openings passing through said upper plug of said housing.

TABLE 1

Milling Test Results

| Case | Dolomite specific surface, $m^2/g$ | | Weight, g | | Surface area, $m^2$ | | Increase in surface area, $m^2$ | Energy use, Kwh | Efficiency $m^2/Kwh$ |
|---|---|---|---|---|---|---|---|---|---|
| | Starting material | Product | Starting material | Product recovered | Starting material | Product | | | |
| Unfluidized Dry Grind | 0.320 | Mixture 0.9505 | 375.8 | Mixture 370.20 | 120.2 | 357.2 | 237 | 0.0870 | $0.2724 \times 10^4$ |
| Wet Grind | 0.320 | Mixture 29.18 | 361.0 | Mixture 336.8 | 115.5 | 10.534 | 10,419 | 0.3459 | $3.012 \times 10^4$ |
| Air Fluidized Bed Grid | 0.320 | Coarse 0.4688<br>Fine 10.65 | 375.0 | Coarse 269.6<br>Fine 105.4 | 120.0 | 1,247[1] | 1,127 | 0.1464 | $0.7711 \times 10^4$ |

[1]Product total surface area for Tests Numbers 1 and 2 equals the mass of the dolomite grain multiplied by dolomite product mixture specific surface area. Product total surface area for Test Number 3 equals the sum of: (A) The coarse product specific surface area multiplied by the mass of coarse product recovered; and (B) the fine-size product specific surface area multiplied by the difference between the masses of the dolomite grain and the coarse product recovered.

5. A gas fluidized-bed stirred media mill as claimed in claim 1, further comprising a means for preventing said relatively large particles from exiting said housing.

6. A gas fluidized-bed stirred media mill as claimed in claim 5, further comprising a means for allowing said relatively small particles to exit said housing.

7. A gas fluidized-bed stirred media mill as claimed in claim 6, wherein said means for preventing said relatively large particles from exiting said housing comprises a deflector rigidly suspended below each said openings in said upper plug of said housing, said deflector positioned to deflect said large particles away from said openings.

8. A gas fluidized-bed stirred media mill as claimed in claim 7, wherein said means for allowing said relatively small particles to exit said housing comprises a passage bounded by an upper surface of said deflector and communicating with said openings in said upper plug of said housing wherein said small particles entrained in said fluidizing gas pass through said passage and exit said housing.

9. A gas fluidized-bed stirred media mill as claimed in claim 1, wherein said fluidizing gas is selected from the group consisting of air, inert gasses, and reactive gasses.

10. A gas fluidized-bed stirred media mill as claimed in claim 2, wherein said rigid porous plate is selected from the group consisting of a sintered metal, a porous ceramic or a porous plastic.

11. A gas fluidized-bed stirred media mill, comprising:

a hollow cylindrical housing having an upper end and a lower end;

a fluidizing gas supply:

a lower plug enclosing said lower end of said housing, said plug including a gas inlet hole and communicating with said fluidizing gas supply;

a means for diffusing said fluidizing gas throughout said lower end of said housing and supporting a volume of particles to be comminuted into relatively large and relatively small particles;

a means for agitating and comminuting said volume of particles comprising:

a stator including a plurality of baffles, said stator disposed within said housing and rigidly affixed to an inner surface of said housing and located above said means for evenly diffusing said fluidizing gas; and a rotor rotatably disposed within said housing, containing a plurality of baffles, said rotor including a lower portion including a plurality of lateral vents, and an upper portion extending through said upper plug and operatively coupled to a means for rotating said rotor;

an upper plug enclosing said upper end of said housing;

a means for exiting said fluidizing gas from said housing; wherein said volume of particles to be comminuted is suspended by said fluidizing gas.

12. A gas fluidized-bed stirred media mill as claimed in claim 11, wherein said means for diffusing said fluidizing gas comprises a fluidizing gas diffuser plate constructed of a rigid porous plate.

13. A gas fluidized-bed stirred media mill as claimed in claim 11, wherein said means for exiting said fluidizing gas from said housing comprises a plurality of openings passing through said upper plug of said housing.

14. A gas fluidized-bed stirred media mill as claimed in claim 11, further comprising a means for preventing said relatively large particles from exiting said housing.

15. A gas fluidized-bed stirred media mill as claimed in claim 14, further comprising a means for allowing said relatively small particles to exit said housing.

16. A gas fluidized-bed stirred media mill as claimed in claim 15, wherein said means for preventing said relatively large particles from exiting said housing comprises a deflector rigidly suspended below each said openings in said upper plug of said housing, said deflector positioned to deflect said large particles away from said openings.

17. A gas fluidized-bed stirred media mill as claimed in claim 16, wherein said means for allowing said relatively small particles to exit said housing comprises a passage bounded by an upper surface of said deflector and communicating with said openings in said upper plug of said housing wherein said small particles entrained in said fluidizing gas pass through said passage and exit said housing.

18. A gas fluidized-bed stirred media mill as claimed in claim 12, wherein said rigid porous plate is selected from the group consisting of a sintered metal, a porous ceramic or a porous plastic.

19. A gas fluidized-bed stirred media mill, comprising:

a hollow cylindrical housing having an upper end and a lower end;

milling media contained within said hollow cylinder;

a lower plug enclosing said lower end of said housing, said plug including a gas inlet hole for communicating with a fluidizing gas supply;

a means for evenly diffusing said fluidizing gas throughout said lower end of said housing and supporting a volume of particles to be comminuted into relatively large and relatively small particles and said milling media, comprising a fluidizing gas diffuser plate constructed of a rigid porous plate;

a means for suspending a substantial portion of said volume of particles to be comminuted;

a means for agitating and comminuting said volume of particles;

an upper plug enclosing said upper end of said housing; and a means for exiting said fluidizing gas from said housing comprising a plurality of openings passing through said upper plug of said housing.

20. A gas fluidized-bed stirred media mill as claimed in claim 19, wherein said means for agitating and comminuting said volume of particles comprises:

a stator including a plurality of baffles, said stator disposed within said housing and rigidly affixed to an inner surface of said cylinder and located above said fluidizing gas diffuser plate; and a rotor rotatably disposed within said housing, containing a plurality of baffles, said rotor including a lower portion including a plurality of lateral vents, and an upper portion extending through said upper plug and operatively coupled to a means for rotating said rotor.

* * * * *